US005867870A

United States Patent [19]

Klüting

[11] Patent Number: 5,867,870

[45] Date of Patent: Feb. 9, 1999

[54] SEPARABLE DOOR HINGE FOR MOTOR VEHICLE DOORS

[75] Inventor: Bernd-Alfred Klüting, Radevormwald, Germany

[73] Assignee: ED. Scharwächter GmbH & Co. KG, Remscheid, Germany

[21] Appl. No.: 886,229

[22] Filed: Jul. 1, 1997

[30] Foreign Application Priority Data

Aug. 8, 1996 [DE] Germany ..... 196 32 027.5

[51] Int. Cl.[6] ..... E05D 7/10

[52] U.S. Cl. ..... 16/254; 16/257; 16/381

[58] Field of Search ..... 16/254, 257–267, 16/270, 273, 386, 387, 380, 381

[56] References Cited

U.S. PATENT DOCUMENTS

| | | | |
|---|---|---|---|
| 807,680 | 12/1905 | Lewis | 16/381 |
| 2,734,223 | 2/1956 | Park | 16/381 |
| 4,542,558 | 9/1985 | Brockhaus | 16/263 |
| 4,860,424 | 8/1989 | Kaibuki et al. | 16/262 |
| 4,864,692 | 9/1989 | Prevot et al. | 16/381 |
| 5,577,295 | 11/1996 | Papke et al. | 16/254 |
| 5,722,121 | 3/1998 | Lau et al. | 16/381 |

*Primary Examiner*—Chuck Y. Mah
*Attorney, Agent, or Firm*—Anderson, Kill & Olick, P.C.

[57] ABSTRACT

A separable door hinge for motor vehicle doors, including two hinge halves having each a gudgeon and attachable, respectively, to one of two parts of a door assembly, a door and a door pillar, a hinge pin for pivotally connecting the two hinge halves with each other and rotatably supported in the gudgeon of one of the two hinge halves with a running fit by a bearing sleeve formed of a maintenance-free bearing material, and form-lockingly secured in the gudgeon of another of the two hinge halves without a possibility of rotation relative to this hinge halves, and a receptacle, which forms an extension of a gudgeon bore of the gudgeon of the another hinge half for receiving at least a front, when viewed in an insertion direction, end portion of the hinge pin.

13 Claims, 9 Drawing Sheets

SEPARABLE DOOR HINGE FOR MOTOR VEHICLE DOORS

BACKGROUND OF THE INVENTION

1. Field of the Invention

The present invention relates to a separable door hinge for motor vehicle doors and including two hinge halves having each at least one gudgeon and attachable, respectively, to one of two parts of a door assembly, a door and a door pillar, and a hinge pin for pivotally connecting the two hinge halves with each other, with the hinge pin being rotatably supported in the at least one gudgeon of one of the two hinge halves with a running fit by a bearing sleeve formed of a maintenance-free bearing material, and with the hinge pin being form-lockingly secured in the at least one gudgeon of another of the two hinge halves without a possibility of rotation relative to another of the two hinge halves.

2. Description of the Prior Art

In the course of manufacturing of a motor vehicle in a contemporary plant, motor vehicles doors are mounted on a vehicle body for their adjustment and varnishing, then during further assembly of the motor vehicle, the doors are taken off, and finally, after being fitted with handles and the like, they are again mounted on the motor vehicle. The initial mounting of a motor vehicle door on the vehicle body provides for proper fitting of the door in the vehicle body and enables to simultaneously varnish the vehicle body together with the door, which insures uniform painting of both the vehicle body and the door. However, this sequence presupposes that the doors are mounted on the vehicle body in their initially adjusted position. Therefore, in order to be able to mount the doors on the vehicle body, during the second mounting, in the initially adjusted or fitted position without any problem, different measures are undertaken. This is achieved, at least in part, by selecting appropriate door hinges.

A suitable door hinge for this purpose has separable hinge halves which are separated from each other during lifting of the door off the vehicle body by withdrawal of the hinge pin, so that one hinge half remains in one of the parts of a door assembly, the door and the door pillar, and another hinge half remains in another part of the door assembly. However, the use of this door hinge presents certain difficulties, in particular during the second mounting of the door on the vehicle body. One of the difficulties consists in that it is rather difficult to align the gudgeon of the door hinge half with the gudgeon of the door pillar door half. Another difficulty consists in that it is difficult to again insert the hinge pin in both gudgeons in its initially aligned position. However, the insertion of the hinge pin in both gudgeons in its initial exact position is absolutely necessary. This is because the hinge half, in which the hinge pin extends with a running fit, has usually a bearing sleeve formed of a maintenance-free bearing material located in its gudgeon bore, and the bearing material is usually relatively soft, so that even with a small tilting of the hinge pin, the bearing sleeve can be damaged and this can make the bearing sleeve useless.

These difficulties are particularly noticeable in door hinges in which the hinge half, in which the hinge pin is located without the possibility of rotation relative to this hinge half, is formed of a sheet metal. The gudgeon of such a hinge half has a small height and does not provide an adequate guidance for the hinge pin during its insertion. With such door hinges, it is further particularly important that the withdrawal and insertion forces applied to the hinge pin be as equal as possible. For insuring the exact aligned position of the hinge pin during its reinsertion, care should be taken that the hinge pin, during its first insertion, performed a certain embossing of the gudgeon. While different door hinges for motor vehicles are essentially identical, except, of course, manufacturing tolerances, it is still important that during the second mounting of the door, the original hinge pin be used.

Accordingly, an object of the present invention is to provide a separable door hinge of the type described above and, in particular, a separable door hinge one hinge half of which is formed as a sheet metal stamped part and which is formed as a pre-assembled unit with a hinge pin that cannot be lost.

Another object of the present invention is to provide a separable door hinge of the above-described type in which exact guidance and retaining of the hinge pin is insured in each of its positions, namely, in separation and connection positions, which insure that the same forces are applied to the hinge pin during both the withdrawal of the hinge pin and the insertion of the hinge pin.

SUMMARY OF THE INVENTION

These and other objects of the present invention, which will become apparent hereinafter, are achieved by providing a hinge pin receptacle, which forms an axial extension of a gudgeon bore of the gudgeon of that hinge half in which the hinge pin is form-lockingly secured without a possibility of rotation relative to this hinge half. In such door hinges, the receptacle, which forms an axial extension of the gudgeon bore, insures a precise alignment of the hinge pin with the gudgeons during each insertion of the hinge pin. This provides for a reliable repetition of separation and assembly of the door hinge under the same conditions and, in particular, for application of the same forces to the hinge pin during its insertion and withdrawal. In addition, the exact alignment of the hinge pin with the gudgeon prevents the bearing sleeve from being damaged. With an appropriate construction, the receptacle can serve as a retainer for the withdrawn hinge pin in the separation position of the door hinge, so that the hinge pin, even it its separation position, is connected with one of the hinge halves.

According to the present invention, the receptacle is advantageously formed as a thin-wall sheet metal sleeve attachable to the outer surface of the gudgeon of that hinge half in which the hinge pin is form-lockingly received without the possibility of rotation relative to this hinge half.

Preferably, the receptacle-forming sheet metal sleeve is formed of a spring steel material and has a plurality of axially extending through slits. Thereby, the hinge pin can be received and guided in the sheet metal sleeve without any backlash. While various means can be used for attaching the sheet metal sleeve to the outer surface of the gudgeon, the attachment is basically effected along a circular track provided on the outer surface concentrically with gudgeon bore at a plurality of connection points on the track.

According to a first, simplest, embodiment of a door hinge according to the present invention, the sheet metal sleeve is formed as a smooth cylindrical shell and has a collar-shaped base portion with which the sheet metal sleeve is secured to the outer surface of the at least one gudgeon of the hinge half in which the hinge pin is form-lockingly received.

According to a second embodiment of a door hinge according to the present invention, the sheet metal sleeve has, along a portion of an axial length thereof a plurality of crimps extending radially inward and peaks of which define a cylindrical surface concentric with a gudgeon bore, and the sheet metal sleeve has at its free end a diameter which is larger than a diameter of the gudgeon bore.

According to a third embodiment of a door hinge according to the present invention, the receptacle-forming sheet metal sleeve can be formed, along with a portion of its axial length, as a cage formed of a plurality of spring tongues.

Independent of a door hinge embodiment, the sheet metal sleeve can be provided with a collar-shaped base portion further provided with a plurality of star-forming, extending radially outwardly lugs with which the sheet metal sleeve is secured to an outer surface of a gudgeon of a hinge half in which the hinge pin form-lockingly received. At that, the lugs can be provided at their free ends with spring tongues engaging in recesses formed in the outer surface and arranged concentrically with the gudgeon bore.

According to a further embodiment of a door hinge according to the present invention, the sheet metal sleeve has a base portion having a plurality of vertically extending end regions which are received in complementary bores provided in an outer portion of the hinge half in which the hinge pin is form-lockingly received, with the vertically extending end regions of the base portion having respective tangent-bent portions engaging the outer portion from beneath.

According to a still further embodiment of the present invention, the sheet metal sleeve has a base portion having a plurality of press-out cylindrical members extending parallel to a sleeve axis and received in complementary bores formed in an outer portion of the hinge half in which the hinge pin is form-lockingly received.

According to yet another embodiment of a door hinge according to the present invention, the sheet metal sleeve has a star-shaped based portion having lugs provided each with a stamped-out pot-shaped portion received in a respective recess provided in an outer portion of the hinge half in which the hinge pin is form-lockingly received According to a particular embodiment of a door hinge according to the present invention, with one hinge half being formed as a stamped sheet metal piece, the sheet metal sleeve includes a base portion formed of a plurality of radially extending lands and a connection ring arranged transverse to a sleeve axis and connecting the radially extending lands, and the outer surface has a plurality of protrusions having each a caulked projections, the connection ring being secured to the outer surface by the caulked projections, providing for securing the sheet metal sleeve to the outer surface.

Apart from the above-discussed embodiments, in which the sheet metal sleeve is secured to an outer surface of a gudgeon of the hinge half, in which the hinge pin is form-lockingly received, by form-and force-locking means, the sheet metal sleeve can be provided with a collar-shaped based portion or a star-shaped portion, and the collar-shaped base portion or the star-shaped base portion is secured to the outer surface by spot welding, pressure welding or projection welding.

According to a yet another embodiment of a door hinge according to the present invention, the receptacle-forming sheet metal sleeve has, at a distance form its base portion, a radially inward deformable region, so that, during the first insertion of the hinge pin, an radially inward extending bead is formed which, together with a complementary construction of the hinge pin, provides for retaining of the hinge pin in its two different mounting positions, namely, in the hinge pin withdrawal, separation position and in the hinge pin inserted, connection position. At that, substantially the same forces are applied to the hinge pin for moving it in both the withdrawal and insertion directions.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
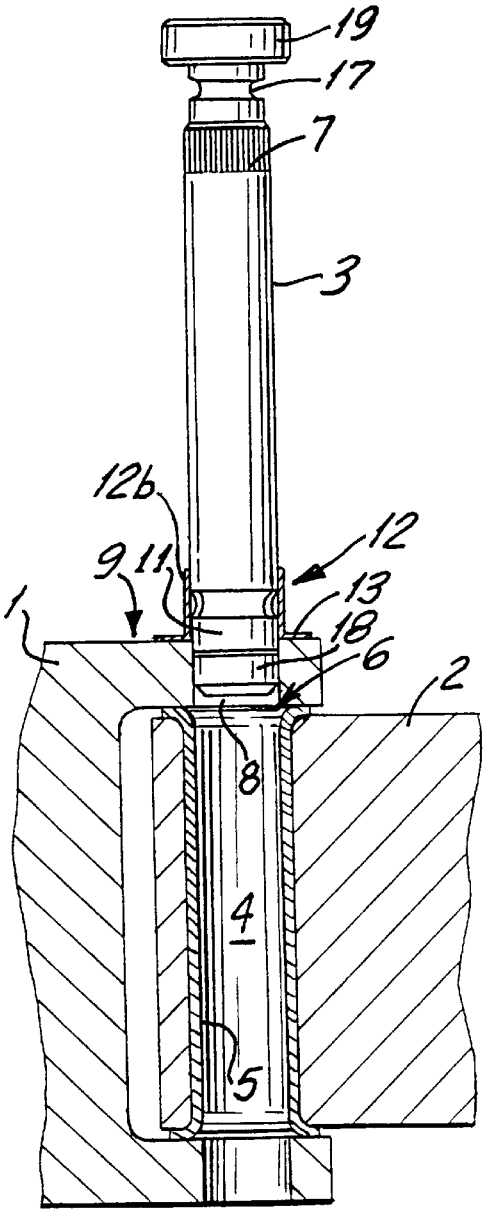
FIG. 1 is a cross-sectional view of a separable motor vehicle door hinge according to the present invention with a hinge pin located in its withdrawn, separation position.
Figure 2:
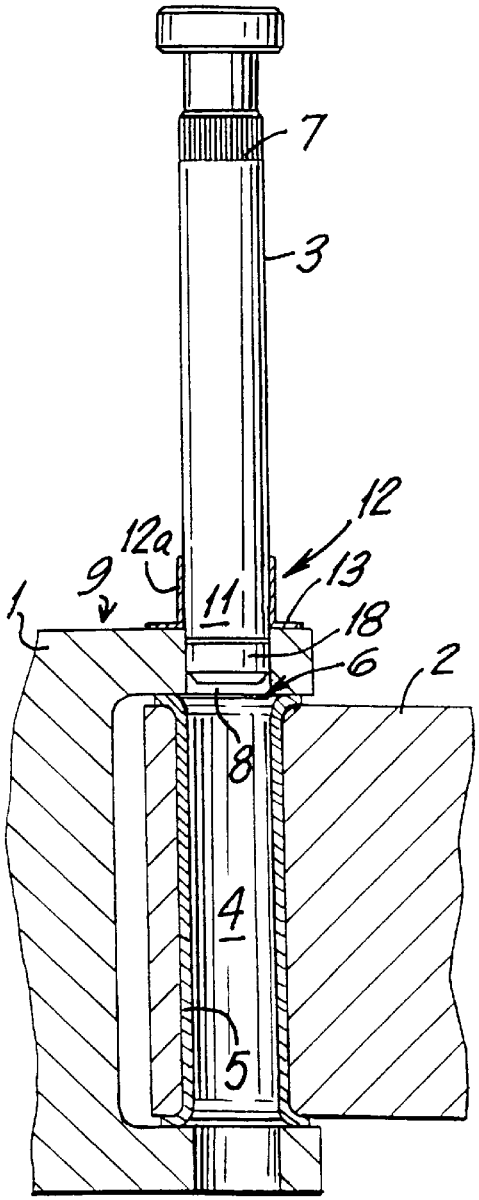
FIG. 2 is a cross-sectional view of a modified embodiment of a separable door hinge according to the present invention with a withdrawn hinge pin located in its separation position.
Figure 3:
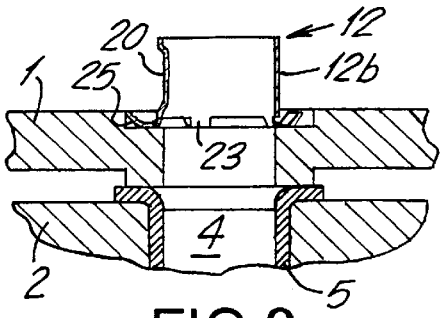
FIG. 3 is a partial cross-sectional view of a motor vehicle door hinge according to the present invention with a hinge pin receptacle.
Figure 6:
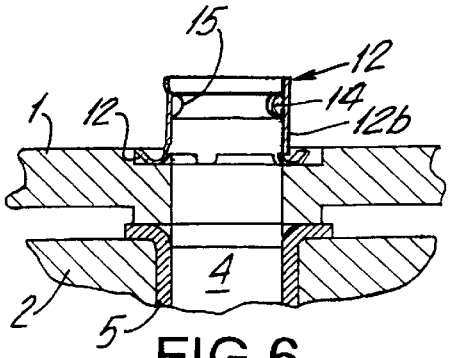
FIG. 6 is a partial cross-sectional view similar to that of FIG. 3 but for the modified embodiment of the motor vehicle door hinge shown in FIG. 2.
Figure 4:
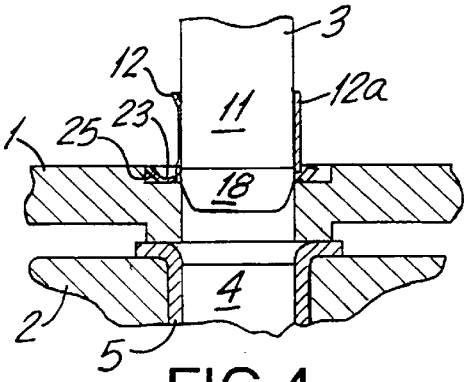
FIG. 4 is a partial cross-sectional view of a motor vehicle door hinge shown in FIG. 3 with a withdrawn hinge pin located in its separation position.
Figure 7:
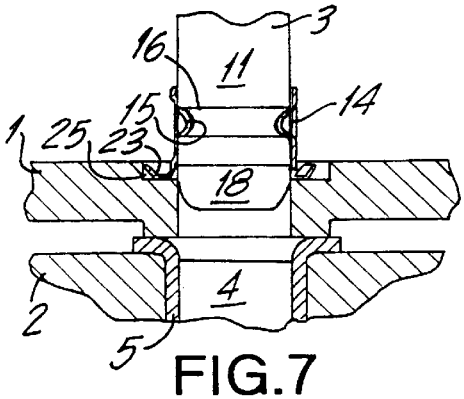
FIG. 7 is a partial cross sectional view similar to that of FIG. 4 but for the modified embodiment of the door hinge shown in FIG. 2.
Figure 5:
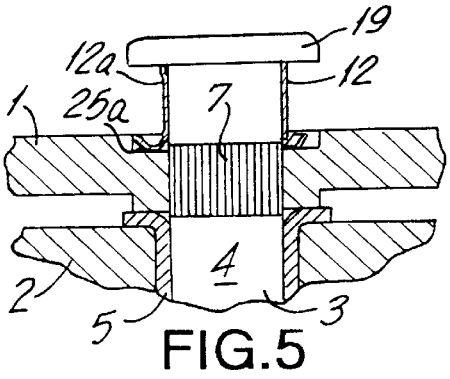
FIG. 5 is a partial cross-sectional view similar to that of FIG. 3 with an inserted hinge pin located in its connection position.
Figure 8:
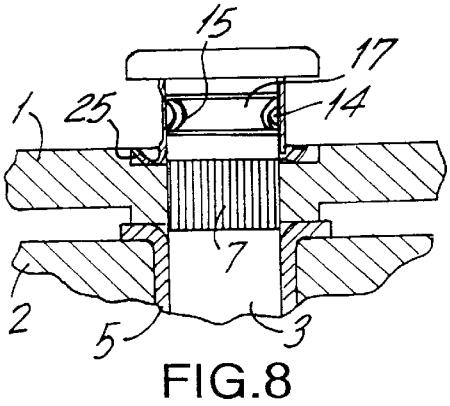
FIG. 8 is a partial cross-sectional view similar to that of FIG. 6 but for the modified embodiment of the door hinge shown in FIG. 6.
Figure 9:
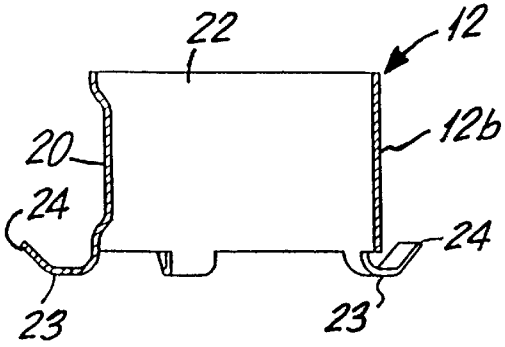
FIG. 9 is a longitudinal cross-sectional view of the receptacle shown is FIGS. 6–8.
Figure 10:
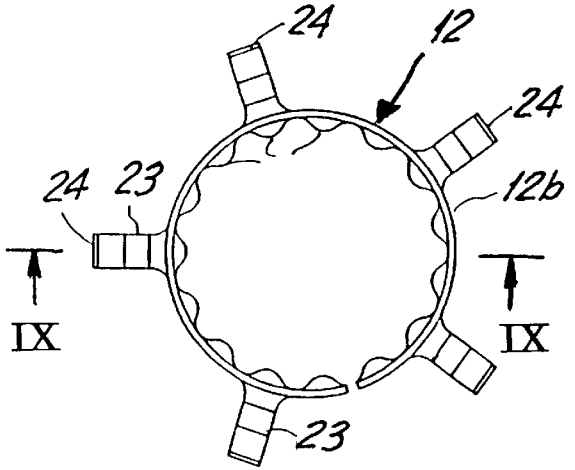
FIG. 10 is a plan view of the receptacle shown in FIG. 9.

A separable motor vehicle door hinge, which is shown more or less schematically in FIGS. 1 and 2, includes two hinge halves 1 and 2 alternatively attachable to two parts of a motor vehicle door assembly (not shown in the drawings), a door and a door pillar. The two hinge halves are pivotally connected with each other, in their assembled or mounted condition, with a hinge pin 3 which is rotatably supported with a running fit in a gudgeon 4 of one of the two halves, the hinge half 2, by a bearing sleeve 5 made of a maintenance-free bearing material. The hinge pin 3 has a shaped portion 7 with which the hinge pin 3 is form-lockingly retained, without a possibility of rotation, in the gudgeon 6 of another hinge half, namely, hinge half 1. The hinge half 1 is formed by a stamped sheet metal part. Therefore, the gudgeon 6 is thin so that the gudgeon bore 8 has a small depth. Thereby, the gudgeon bore 8 does not interfere with the hinge pin withdrawal, nor does it provide good guiding for the hinge pin 3 during its insertion. At the outer side 9 of the gudgeon 7 of the hinge half 1, in all embodiments, there is provided a receptacle 12, which is located in a direction of axial extension of the bore 8 of the gudgeon 6, for receiving an end portion 11 of the hinge pin 3.

In the embodiment of FIGS. 1–12, the receptacle 12, associated with the hinge pin 3, is formed as a thin sheet metal sleeve 12*a* having a smooth cylindrical surface and a collar-shaped base portion 13 with which the sleeve 12*a* is fixedly secured to the outer surface 9 of the gudgeon 6, in which the hinge pin 3 is form-lockingly received. The sleeve 12*a* is aligned with gudgeon bore 8 of the gudgeon 6.

The embodiment of the door hinge shown in FIG. 2 differs from the embodiment of the door hinge shown in FIG. 1 in that the receptacle-forming sleeve 12*a* has a radially inward-deformable region 14. As a result, during the first insertion of the hinge pin 3 into the gudgeon bores of the hinge halves 1 and 2, an inwardly directed bead 15 is formed which, together with two circumferential grooves 16 and 17 of the hinge pin 3, provides for securing the hinge pin 3 in two different mounting positions of the hinge pin 3, namely, in separation and connection positions of the hinge pin 3. As show in FIG. 2, one of the grooves, the groove 16 is spaced from the front end 18 of the hinge pin 3, whereas the other groove 17 is located adjacent to a head 19 of the hinge pin 3 In the embodiments of FIGS. 1 and 3–5, the sheet metal sleeve 12*a* has a continuous cylindrical surface, whereas in the embodiments of FIGS. 2 and 6–16, the receptacle-forming sheet metal sleeve 12*b* is provided long a portion of its axial length with a crimp 20 directed radially inward, with the peaks 21 of the crimp 20 forming a cylindrical surface concentric with the gudgeon bore 8. The sheet metal sleeve 12 has, at least at its free end, a diameter 22 larger than that of the gudgeon bore 8.

To provide for fixed connection of the receptacle-forming sheet metal sleeve 12*b* to the outer surface 9 of the gudgeon 6, the sleeve 12*b* has a star-shaped base crown portion 23, with the free ends of the crown being formed as spring tongues 24. The spring tongues 24 are engaged in a recess 25 formed in the outer surface 9 of the gudgeon 6, providing for securing of the sheet metal sleeve 12*b* to the outer surface 9.

Figure 11:
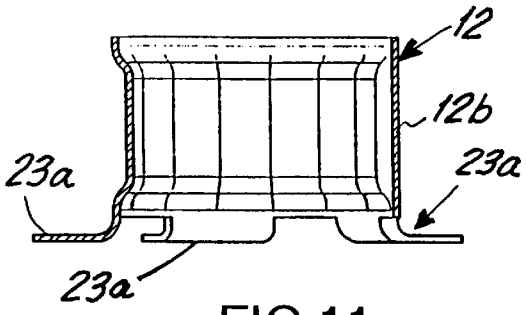
FIG. 11 is a longitudinal cross-sectional view of a modified receptacle.
Figure 12:
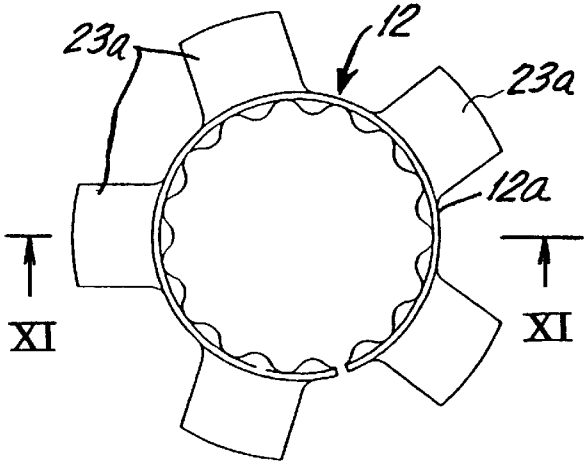
FIG. 12 is a plan view of the receptacle shown in FIG. 11.
Figure 15:
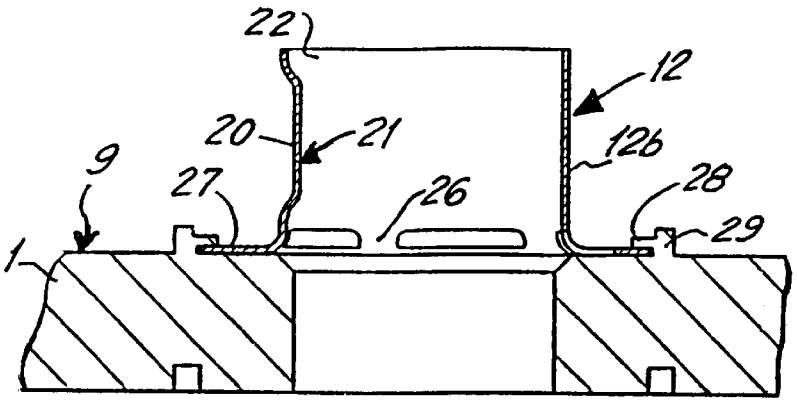
FIG. 15 is a cross-sectional view showing attachment of a receptacle according to FIG. 13 and 14 at the outer side of a commercial door hinge.
Figure 16:
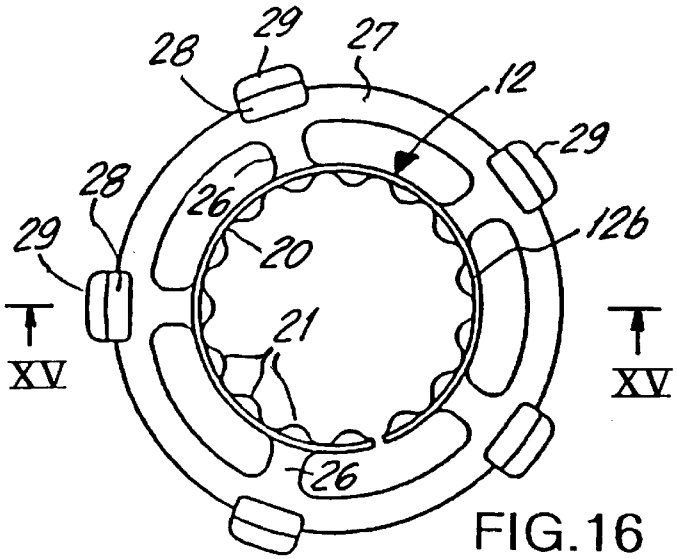
FIG. 16 is a plan view of the attachment shown in FIG. 15.
Figure 13:
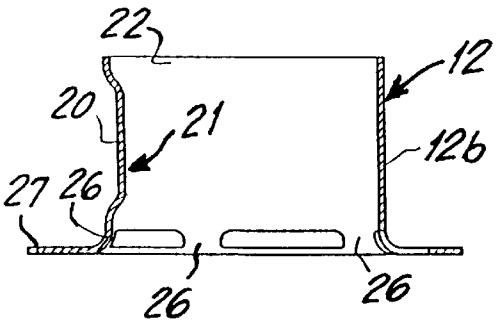
FIG. 13 is a longitudinal cross-sectional view of a yet another modified receptacle.
Figure 14:
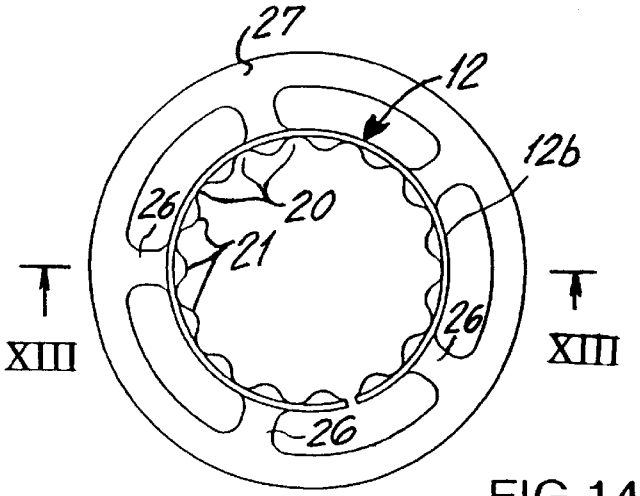
FIG. 14 is a plan view of the receptacle shown in FIG. 13.

The embodiment of the receptacle-forming sheet metal sleeve 12*a*, which is shown in FIGS. 11–12, is characterized in that the star-shaped base portion has five lugs 12*a* which abut a flat outer surface 9 of the gudgeon 6 and are connected thereto in a conventional manner The embodiment of the receptacle-forming sheet metal sleeve 12*a*, which is shown in FIGS. 13–16, distinguishes by a particularly good suitability for being secured to the pressed hinge half 1 which is formed of a sheet metal. In the embodiment of FIGS. 13–16, the receptacle-forming sheet metal sleeve 12*a* has a plurality of radially extending lands 26 which are connected with a connection ring 27, which lies perpendicular to the receptacle axis and is secured to the outer surface 9 of the gudgeon 6 by a caulked projections 28 formed on protrusions 29 formed on the outer surface 29.

In the embodiment shown in FIGS. 3–16, the receptacle-forming sheet metal sleeve 12*c* is formed of sheet spring steel and is provided with axially extending slits 30.

The receptacle 12, which is shown in FIGS. 17–33, distinguishes from the receptacle 12 shown in FIGS. 1–16 in that the receptacle 12 is formed as cage consisting of spring tongues 31 the ends of which are connected by an annular member 32. The spring tongue 31 are provided, at a distance from their free ends, with detent portions 33 which extends radially inward and provide, together with one of two radially extending grooves 16 and 17 of the hinge pin 3, for retention of the hinge pin 3 in the two mounting positions, namely, in the withdrawn separation position and in the inserted connection position.

Figure 17:
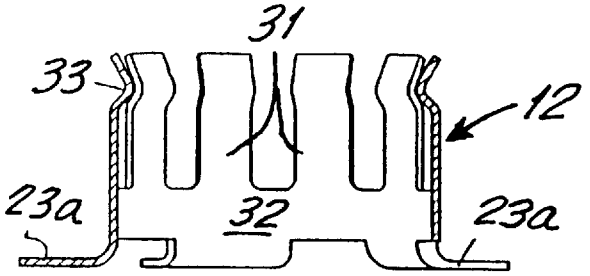
FIG. 17 is a longitudinal view of another embodiment of a hinge pin receptacle.
Figure 19:
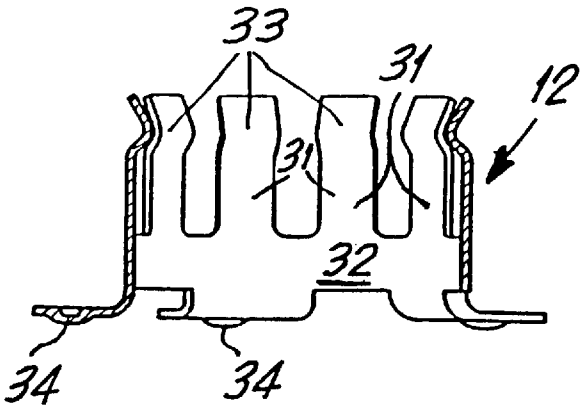
FIG. 19 is a longitudinal view of a modified receptacle.
Figure 18:
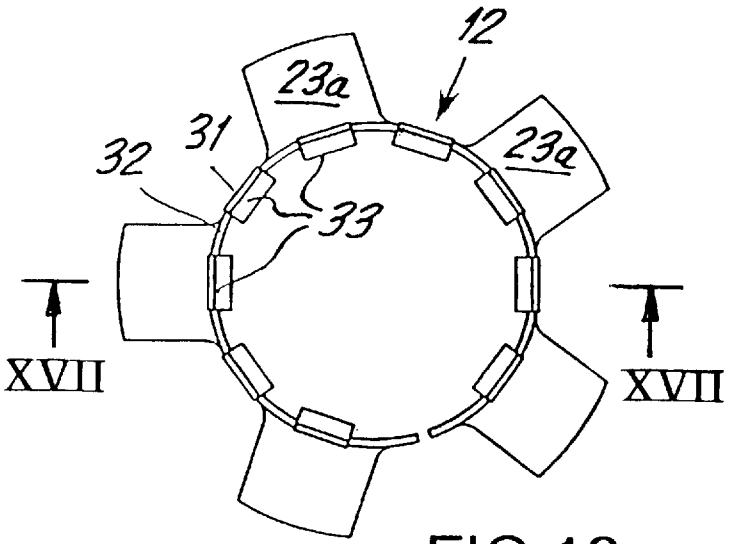
FIG. 18 is a plan view of the receptacle shown in FIG. 17.
Figure 20:
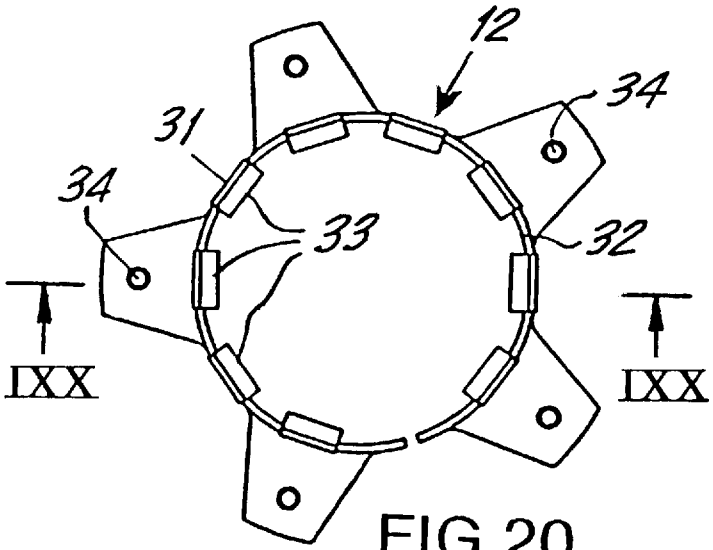
FIG. 20 is a plan view of the receptacle shown in FIG. 19.

In the embodiment shown in FIGS. 17 and 18, the base portion 23 of the receptacle has a plurality of lugs 23*a* which abut a flat outer surface 9 of the gudgeon and are connected thereto in conventional manner.

Figure 21:
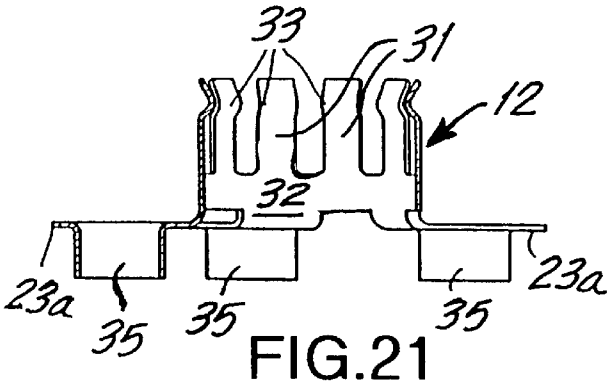
FIG. 21 is a longitudinal view of a further modified receptacle.
Figure 22:
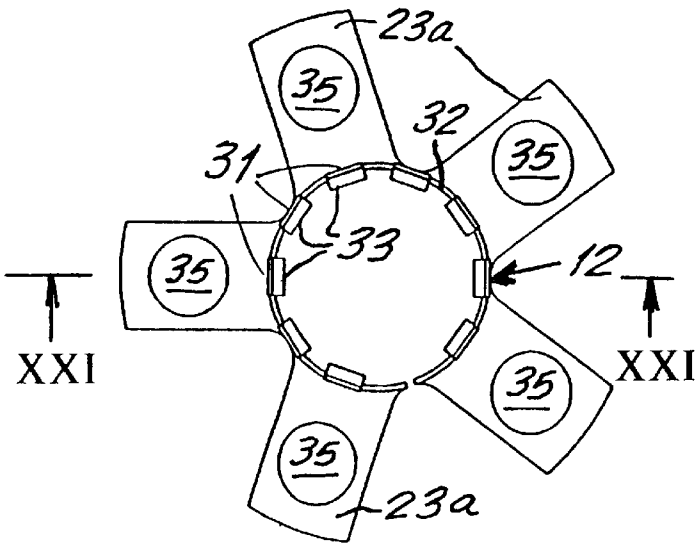
FIG. 22 is a plan view of the receptacle shown in FIG. 21.

In the embodiment shown in FIGS. 21–22, the lugs 23*a* of the star-shaped base portion 23 of the receptacle 12 have each an axially extending cylindrical jut 35 with which the receptacle 12 is form-lockingly secured to the outer surface 9 of the gudgeon 6.

Figure 23:
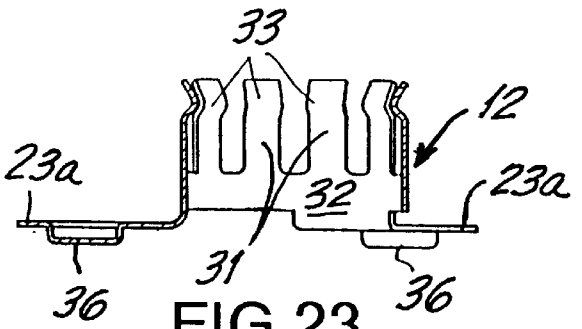
FIG. 23 is a longitudinal view of a still further modified receptacle.
Figure 24:
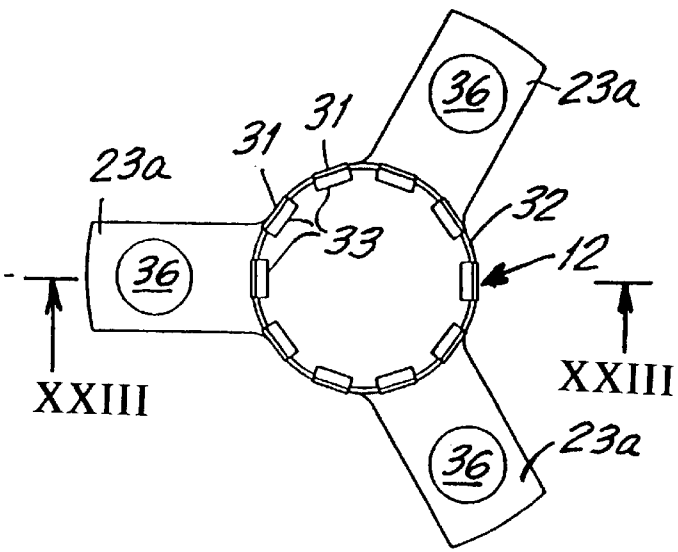
FIG. 24 is a plan view of the receptacle shown in FIG. 23.
Figure 30:
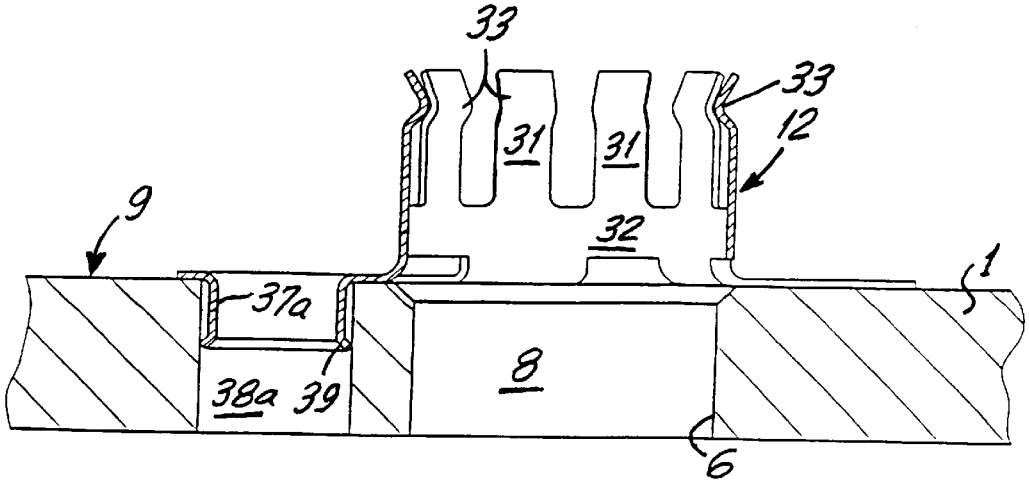
FIG. 30 is a longitudinal view of a further modified embodiment of an attachment of the receptacle shown in FIGS. 21–22.

In the embodiment shown in FIGS. 23–24, the lugs 23*a* of the base portion 23 of the receptacle 12 have each an axially extending pressed-out member 36, with which members 36 the receptacle 12 is form-lockingly secured to the outer surface 9 of the gudgeon 6. A variation of this embodiment of the receptacle 12 is shown in FIG. 30 in which one of the radially extending lugs 23 of the base portion of the receptacle 12 has an axially extending 37*a* which is form-lockingly received in a base 38*a* formed in the outer surface 9 of the gudgeon 6 of the hinge half 1. At its free end, the cylindrical just has, as shown in FIG. 30, an extending radically outwardly widening portion 39.

Figure 25:
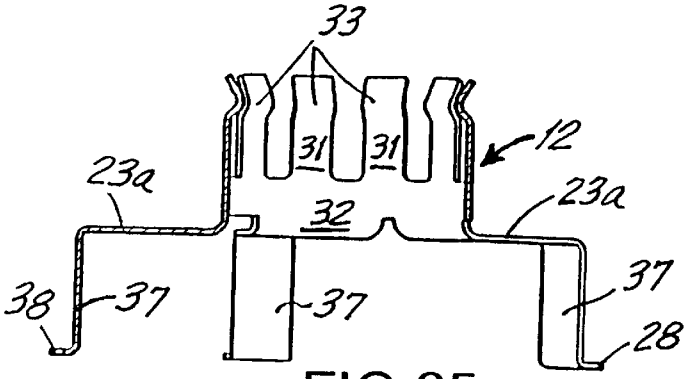
FIG. 25 is a longitudinal view of a yet another modified receptacle.
Figure 26:
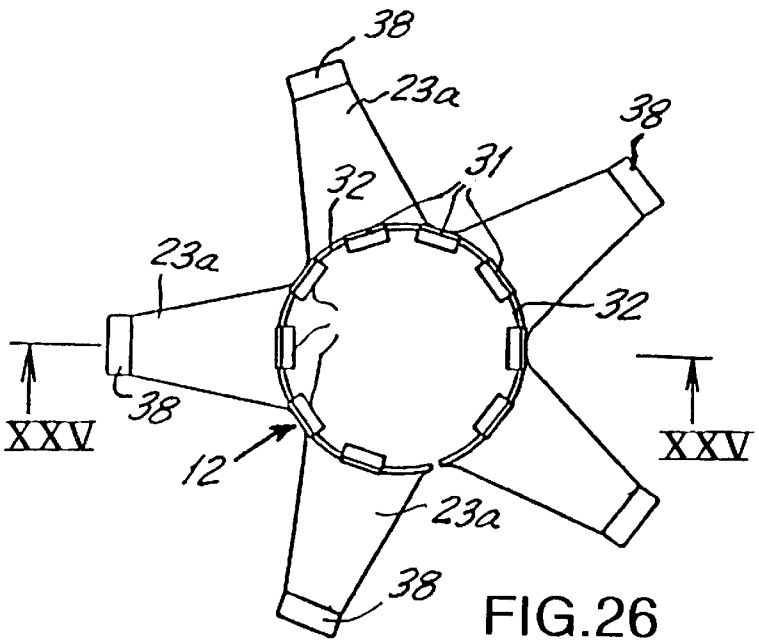
FIG. 26 is a plan view of a receptacle shown in FIG. 25.

In the embodiment shown in FIGS. 25–26, the lugs 23*a* of the star-shaped base portion 23 of the receptacle 12 have vertically (axially) extending end regions 37 which engage in complimentary recesses formed in the outer portion of the gudgeon 6 of the hinge half 1.

Figure 29:
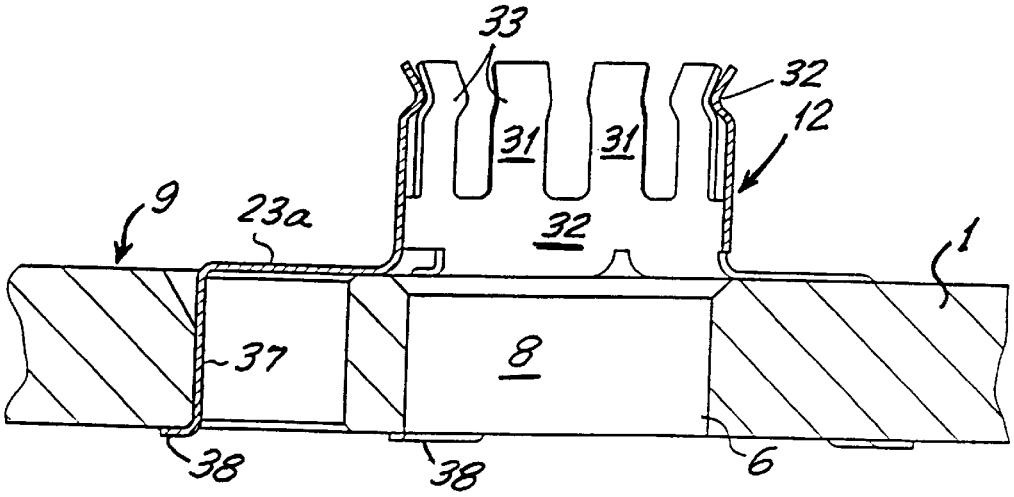
FIG. 29 is a longitudinal view of a modified embodiment of an attachment of a receptacle show in FIGS. 21–22.

In the embodiment of FIG. 29, the end regions 37 are provided with tangent-bent portions 38 which engage the outer portions of the hinge half from beneath, securing the receptacle 12 in the gudgeon 6.

Figure 27:
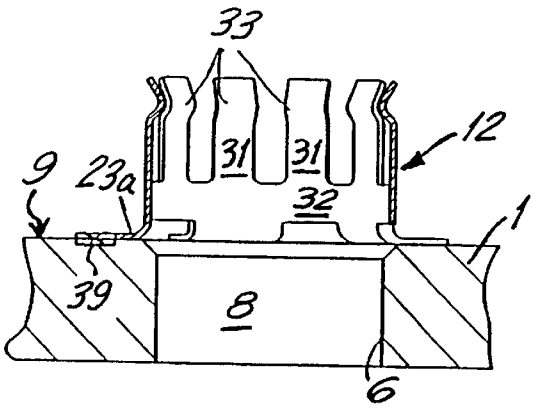
FIG. 27 is a longitudinal view of an attachment of the receptacle show in FIGS. 21–22.
Figure 28:
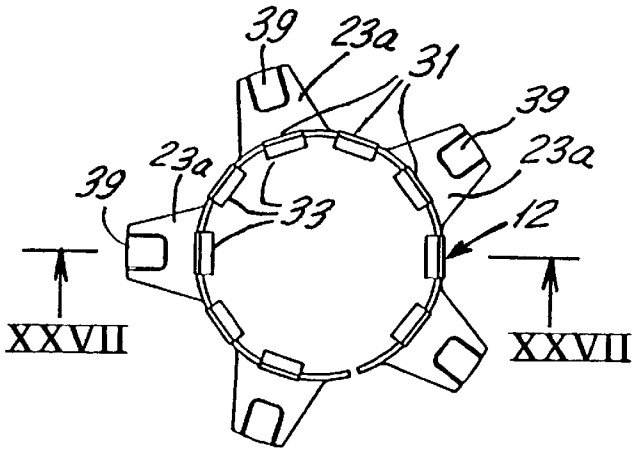
FIG. 28 is a plan view of the attachment show in FIG. 27.
Figure 33:
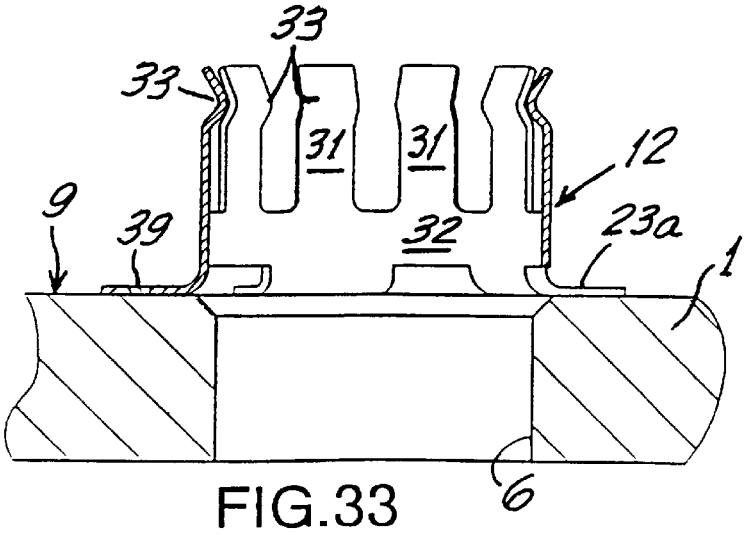
FIG. 33 is a longitudinal view of a simplified attachment of the receptacle shown in FIGS. 21–22.

In the embodiment shown in FIGS. 27, 28 and 33, the lugs 23*a* of the star-shaped base portion 23 of the receptacle-forming sheet metal sleeve 12*a* have stamped-out portions 39 which are received in complimentary indentations provided in the outer surface 9 of the hinge half 1 for securing the receptacle 12 thereto.

Figure 31:
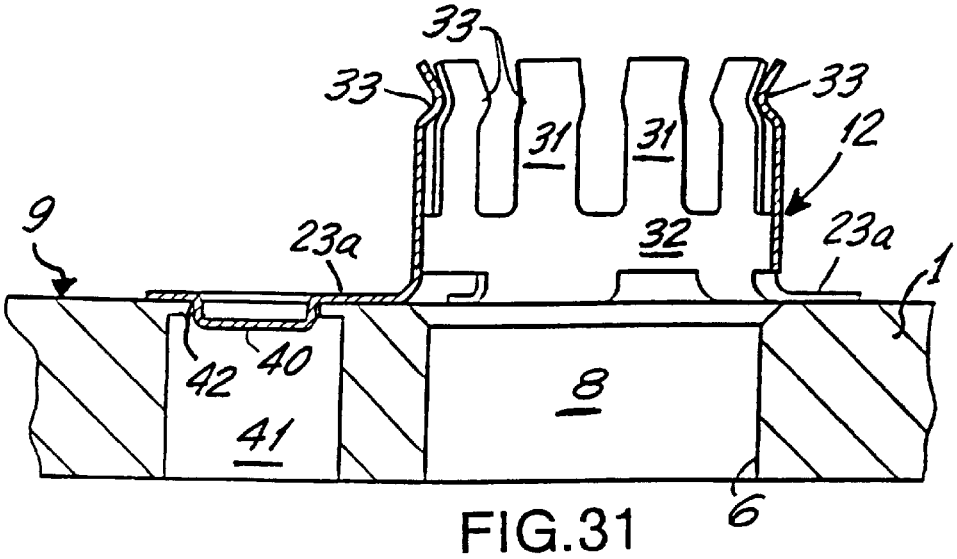
FIG. 31 is a longitudinal view of a still further modified embodiment of an attachment of the receptacle show in FIGS. 21–22.
Figure 32:
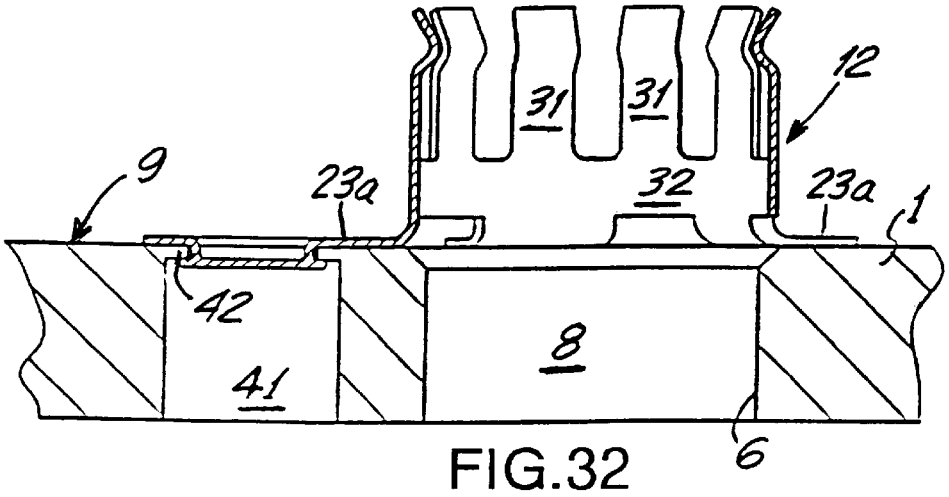
FIG. 32 is a longitudinal view of a modified embodiment of an attachment shown in FIG. 31 effected with the use of rivets.

In the embodiment shown in FIGS. 31 and 32, the receptacle-forming sheet metal sleeve 12*a* is secured to the outer surface 9 of the hinge half 1 with rivets. To this ends, the radially extending lugs 23*a* of the base portion 23 of the sheet metal sleeve 12*a* are provided with axially extending stamped-out pot-shaped portions 40 which are received in bores 41 formed in the outer surface 9 of the gudgeon 6 of the hinge half 1. The lugs 23*a* are secured to undercuts 42 by riveting.

Though the present invention was shown and described with reference to the preferred embodiments, various modifications thereof will be apparent to those skilled in the art, and therefore, it is not intended that the invention be limited to the disclosed embodiments or details thereof, and departure can be made therefrom within the spirit and scope of the appended claims.

What is claimed is:

1. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, wherein the sheet metal sleeve is formed as a smooth cylindrical shell and has a collar-shaped base portion with which the sheet metal sleeve is secured to the outer surface of the at least one gudgeon of the another hinge half, and wherein the sheet metal sleeve is fixedly secured to the outer surface of the last least one gudgeon of the another hinge half at connection points provided on a circular track provided on the outer surface concentrically with a gudgeon hole.

2. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the outer surface of the at least one gudgeon of the another hinge half has a recess formed concentrically with a gudgeon bore, and the sheet metal sleeve has a collar-shaped base portion with extending radially outwardly lugs provided at free ends thereof with spring tongues engaging in the recess formed in the outer surface.

3. A separate door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the act least one gudgeon of the another hinge half, and wherein the sheet metal sleeve has a star-shaped based portion having lugs extending radially outwardly and received in complementary recesses provided in the outer surface.

4. A separable door hinge for motor vehicle doors, comprising two hinge having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the act least one gudgeon of the another hinge half, and wherein the sheet metal sleeve has a base portion having a plurality of vertically extending end regions which are received in complementary bores provided in an outer portion of the another hinge half.

5. A door hinge as set forth in claim 4, wherein the vertically extending end regions of the base portion have respective tangent-bent portions engaging the outer portion from beneath.

6. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve has a base portion having a plurality of press-out cylindrical members extending parallel to a sleeve axis and received in complementary bores formed in an outer portion of the another hinge half.

7. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve has one of a collar-shaped base portion and a star-shaped base portion, and wherein the one of the collar-shaped base portion and the star-shaped base portion is secured to the outer surface by one of spot welding, pressure welding and projection welding.

8. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve has a star-shaped based portion having lugs provided each with a stamped-out pot-shaped portion received in a respective recess provided in an outer portion of the another hinge half.

9. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve includes a base portion formed of a plurality of radially extending lands and a connection ring arranged transverse to a sleeve axis and connecting the radially extending lands, and wherein the outer surface has a plurality of protrusions having each a caulked projection, the connection ring being secured to the outer surface by the caulked projections, providing for securing the sheet metal sleeve to the outer surface.

10. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve comprises a springtongue cage formed of a plurality of spring tongues, and wherein the plurality of spring tongues have each, at a distance from a base portion of the sheet metal sleeve, a detent portion extending radially inward.

11. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve has, along a portion of an axial length thereof a plurality of crimps extending radially inward and peaks of which define a cylindrical surface concentric with a gudgeon bore, and wherein the sheet metal sleeve has at a free end thereof a diameter which is larger than a diameter of the gudgeon bore.

12. A separable door hinge for motor vehicle doors, comprising:

two hinge halves having each at least one gudgeon and attachable, respectively, to one of two parts of a door assembly, a door and a door pillar;

a hinge pin for pivotability connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an outer surface of the at least one gudgeon of the another hinge half, and wherein the sheet metal sleeve is formed along a portion of an axial length thereof as a cage formed of spring tongues.

13. A separable door hinge for motor vehicle doors, comprising:

two hinge halves having each at least one gudgeon and attachable, respectively, to one of two parts of a door assembly, a door and a door pillar;

a hinge pin for pivotally connecting the two hinge halves with each other, the hinge pin being rotatably supported in at least one gudgeon of one of the two hinge halves with a running fit by a bearing sleeve formed of a maintenance-free bearing material, and the hinge pin being form-lockingly secured in the at least one gudgeon of another of the two hinge halves without a possibility of rotation relative to the another of the two hinge halves; and a receptacle, which forms an extension of a gudgeon bore of the at least one gudgeon of the another of the two hinge halves for receiving at least a front, when viewed in an insertion direction, end portion of the hinge pin, wherein the receptacle comprises a thin-wall sheet metal sleeve secured to an other surface of the at least one gudgeon of the another hinge half, and wherein the sheet metal sleeve is formed of a sheet spring metal and has a plurality of through slits.

* * * * *